United States Patent [19]

Lipowski et al.

[11] 4,074,968

[45] Feb. 21, 1978

[54] RETANNING AND FATLIQUORING AGENT

[75] Inventors: Stanley A. Lipowski, Livingston, N.J.; Joseph W. Dehn, Jr., Great Neck, N.Y.; Clinton E. Retzsch, Morris Township, Morris County, N.J.

[73] Assignee: Diamond Shamrock Corporation, Cleveland, Ohio

[21] Appl. No.: 677,494

[22] Filed: Apr. 15, 1976

[51] Int. Cl.[2] ..... C14C 3/20; C14C 9/02

[52] U.S. Cl. ..... 8/94.22; 8/94.21; 8/94.23; 8/94.24

[58] Field of Search ..... 8/94.22, 94.23, 94.24, 8/94.19 R

[56] References Cited

U.S. PATENT DOCUMENTS

| | | | |
|---|---|---|---|
| 3,512,918 | 5/1970 | Endres et al. | 8/94.24 |
| 3,650,666 | 3/1972 | Shimizu et al. | 8/94.22 |
| 3,973,904 | 8/1976 | Endres et al. | 8/94.22 |
| 3,988,247 | 10/1976 | Dieckelmann et al. | 252/8.7 |

*Primary Examiner*—John Kight, III

*Attorney, Agent, or Firm*—Neal T. Levin; Leslie G. Nunn

[57] ABSTRACT

Sulfonated resins useful as retanning and fatliquoring agents are obtained by sulfonation of a condensation product of (a) one mole of a hydroxy aromatic component, (b) from about 0.05 to 1.5 mole of an unsaturated oil and (c) about 0.4 to about 1.0 mole of a formaldehyde liberating composition. The hydroxy aromatic component may be phenol, a lower alkyl phenol having at least one reactive hydrogen in the 2-,4- or 6-position on the aromatic ring or a mixture thereof. The unsaturated oil may be castor oil or moellon. The formaldehyde liberating composition may be formaldehyde or a composition capable of producing formaldehyde.

22 Claims, No Drawings

RETANNING AND FATLIQUORING AGENT

BACKGROUND OF THE INVENTION

1. Field of the Invention

This invention relates to a retanning and fatliquoring agent for use in tanning.

2. Description of the Prior Art

U.S. Pat. No. 3,650,666, Schimizu et al issued Mar. 21, 1972 describes tannable fatliquoring agents which exhibit not only fatliquoring but also tanning effects with respect to hides and skins. The principal component in these tanning fatliquoring agents is a phenolic compound having a long chain alkyl or alkenyl radical attached to the phenol ring. These agents include synthetic products such as octylphenol, nonylphenol and natural products such as cashew nut shell liquids, urushiol and laccol. Methods of preparing these compounds are well known in the art so this invention is directed to the use of these compounds as tannable fatliquoring agents.

Since these agents are capable of accomplishing both tanning and fatliquoring, the agent may be used in the fatliquoring step after ordinary tanning or it may be mixed with an ordinary tanning agent and used in a one step process to accomplish simultaneously both tanning and fatliquoring.

U.S. Pat. No. 3,927,966 - Leberfinger et al, issued Dec. 23, 1975 describes a fatliquoring chrome-tanning agent which is a spray dried powder of a mixture of chromium sulfate and a higher molecular weight alkyl sulfonate which can be used in simultaneous chrome-tanning and fatliquoring or simultaneous retanning and oiling. The mixture may also contain paraffinic hydrocarbons, cation-active emulsifiers and/or anion-active fatty alcohol polyglycol ether sulfates. The spray dried products are completely soluble in water and do not cause separation of an oily deposit which is formed if the mixture of alkyl sulfonate emulsion and chromium sulfate solution are not spray dried.

There is a need for further improvements in agents which are useful both as retanning and fatliquoring agents.

SUMMARY OF THE INVENTION

Sulfonated resins are useful as retanning and fatliquoring agents. The sulfonated resin may be the sulfonated condensate of (a) one mole of the hydroxy aromatic component and (b) from about 0.05 to about 1.5 mole of an unsaturated oil with from about 0.4 to 1.0 mole of formaldehyde per mole of the hydroxy aromatic component. The hydroxy aromatic component may be phenol, a lower alkyl phenol such as methylphenol, ethylphenol and dimethylphenol or a mixture thereof. More specifically, each mole of the hydroxy aromatic component contains from about one mole of phenol, a substituted phenol having at least one reactive hydrogen in the 2-,4- or 6-position of the aromatic ring or a mixture thereof. The $SO_3$ content of the sulfonated resin is from about 0.3 to about 1.5 mole per mole of the hydroxy aromatic component.

DESCRIPTION OF PREFERRED EMBODIMENTS

Preparation and use of these sulfonated resins as retanning and fatliquoring agents are described in greater detail below.

Chemistry of Retanning and Fatliquoring Agents

When a mixture of phenol, cresol and an unsaturated oil such as castor oil is reacted under acidic conditions with formaldehyde, a series of complicated reactions takes place. These reactions include:

1. Resinification of methylolated phenolic compounds forms Novolak resins, that is, linear condensation products of monomethylol phenols:

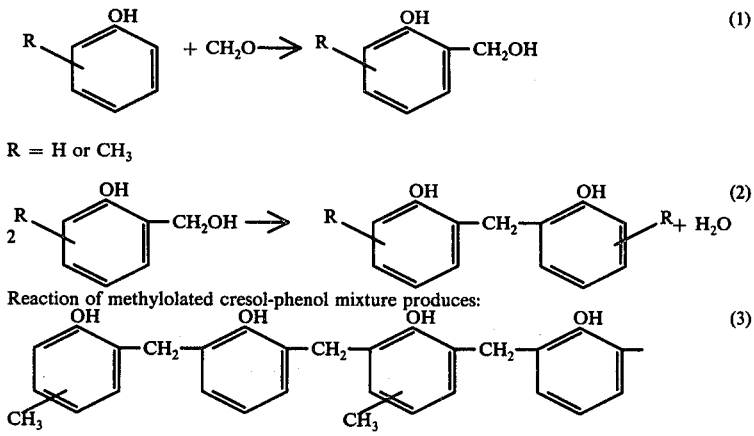

2. Reaction of formaldehyde with the hydroxyl group of the ricinoleic acid produces formaldehyde acetals or formals:

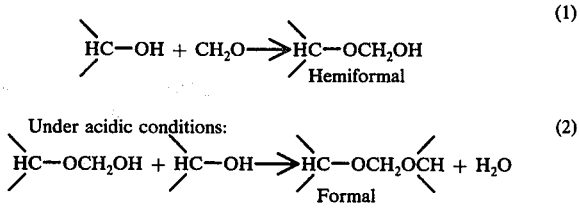

3. Acid catalyzed, formaldehyde - double bond reaction (Prins reaction) involves addition of methylene glycol to a carbon - carbon double bond:

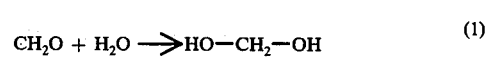

-continued

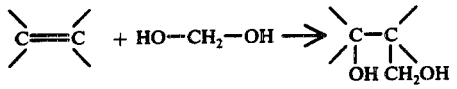

(2)

Under acidic conditions the Prins reaction mechanism can be explained as involving formation of a carbonium ion derived from methylene glycol:

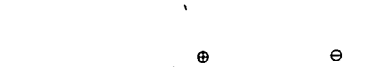

(1)

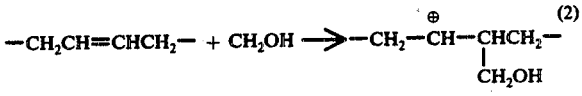

(2)

With water the intermediate ion from reaction (2) yields a glycol:

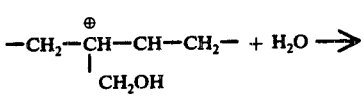

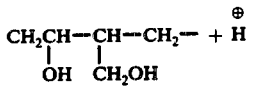

(3)

4. When a mixture of the phenolic materials and unsaturated oils such as castor oil and formaldehyde is resinified under acid conditions and then dehydrated at elevated temperature under vacuum, formation of a combined phenolic - fatty resin through a methylene bridge linkage is expected:

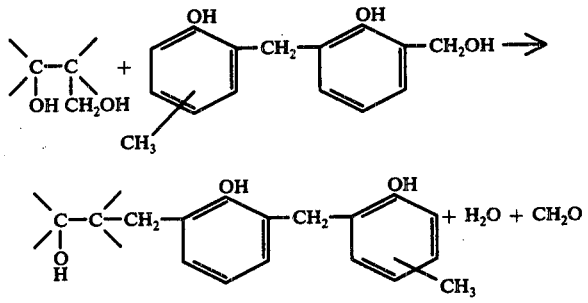

5. After sulfonation of the anhydrous resin, then dilution and neutralization of the sulfonic acid groups in the resin with sodium hydroxide, the sulfonated resin may be represented by the following formula:

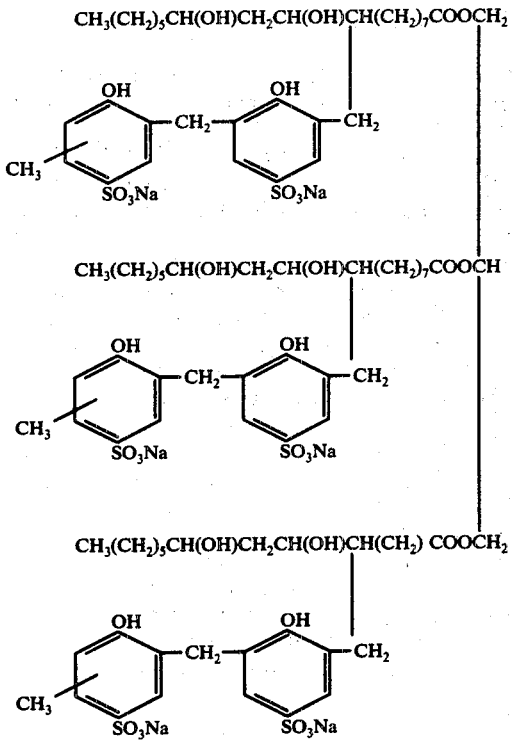

tris (10,12-dihydroxy, 9-methylene - hydroxyphenyl, cresyl - methane disodium sulfonate octadecenoic) glyceride. It is to be understood that the composition of the sulfonated resin may vary depending on the ratios of the reacted materials.

The Hydroxy Aromatic Component

The various methylphenols, ethylphenols and dimethylphenols which can be present with phenol in the hydroxy aromatic component are described in greater detail below. Formulas I and II, wherein R represents a methyl or ethyl radical, exemplify substituted phenols which have reactive hydrogen atoms in each of the 2-, 4- and 6-positions of the aromatic rings. Such phenols include 3-methylphenol (m-cresol), 3-ethylphenol, 3,5-dimethylphenol (sym-m-xylenol), 3,5-diethylphenol and the like.

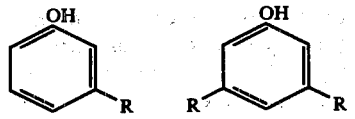

(I) (II)

Formulas III-VII inclusive, wherein R represents a methyl or ethyl radical, exemplify substituted phenols which have reactive hydrogen atoms in both the 4- and 6-positions of the aromatic ring or which have reactive hydrogen atoms in both the 2- and 6-positions of the aromatic ring.

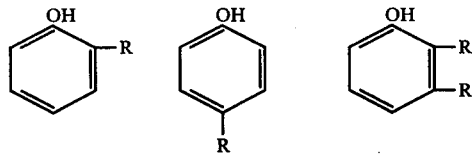

(III) (IV) (V)

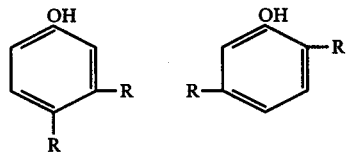

(VI) (VII)

Such phenols include 2-methylphenol (o-cresol), 2-ethylphenol, 4-methylphenol (p-cresol), 4-ethylphenol, 2,3-dimethylphenol (vic-o-xylenol), 2,3-diethylphenol, 3,4-dimethylphenol (uns-o-xylenol), 3,4-diethylphenol, 2,5-dimethylphenol (p-xylenol), 2,5-diethylphenol and the like.

Formulas VIII and IX, wherein R represents a methyl or ethyl radical, exemplify substituted phenols which have a reactive hydrogen in the 4-position of the aromatic ring as the sole reactive hydrogen or which have a reactive hydrogen in the 6-position of the aromatic ring as the sole reactive hydrogen atom. Such phenols include 2,4-dimethylphenol (uns-m-xylenol), 2,4-diethylphenol, 2,6-dimethylphenol (vic-m-xylenol), 2,6-diethylphenol and the like.

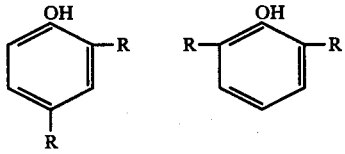

(VIII) (IX)

These phenols act as chain terminators and the amount of 2,6-dimethylphenol or 2,4-dimethylphenol, when used should not exceed a total of 0.05 mole per mole of the hydroxy aromatic component.

Useful unsaturated oils include those having an iodine value of over 60 and include, but are not limited to: vegetable oils such as acorn, almond, apricot kernel, beechnut, black mustard, brazil nut, candlenut, cashew nut shell, castor, chaulmoogra, corn, cottonseed, croton, grape seed, hazelnut, laurel, lemon, linseed, oat, olive, peach kernel, peanut, pecan kernel, perilla, pistachio nut, plum kernel, pumpkin seed, rape seed, rice bran, safflower, sesame, soya, sunflower, tung, walnut, wheat, and mustard seed; animal oils such as lard-oil and neatsfoot, and fish oils such as cod, cod liver, dogfish, herring, menhaden, sardine, shark, whale, castor oil and modified oils such as blown oils, acetylated oils and chlorinated oils.

Preferred unsaturated oils include those having an iodine value over 90, for example, castor, cod, cod liver, corn, cottonseed, croton, herring, lemon, linseed, neatsfoot, peanut, pecan, rape seed, rice bran and teaseed, and blown oils such as a blown codfish oil.

Unsaturated oils also include unsaturated fatty acids such as unsaturated fatty acids having one double bond such as caproleic, myristoleic, palmitoleic, petroselinic, oleic, raccenic, gadoleic, gondoic, cetoleic, erucic, selacholeic and ximenic; unsaturated fatty acids having two double bonds such as stillingic, linoleic, 11,14-eicosadienoic and 13,16-docosadienoic; unsaturated fatty acids having three double bonds such as hiragonic, 6,9,12-octadecatrienoic, linolenic, 5,8,11-eicosatrienoic, 8,11,14-eicosatrienoic, and 7,10,13-docosatrienoic; unsaturated fatty acids having four or more double bonds such as 4,8,11,14-hexadecatetraenoic, 6,9,12,15-hexadecatetraenoic, moroctic, arachiodonic, clupanodonic, and nisinic; unsaturated fatty acids having conjugated double bonds such as alpha-eleostearic, alpha-punicic, alpha-kamlolenic, alpha-licanic and alpha-parinaric; substituted unsaturated fatty acids having a hydroxy or epoxy group such as ricinoleic, 2-hydroxy-12-octadecenoic, and vernolic; unsaturated fatty acids having a triple bond or a triple bond and a double bond such as tariric, ximenynic (santalbic), and isanic (erythrogenic); hydnocarpic, chaulmoogric and gorlic; unsaturated dimer acids, mixtures of fatty acids derived from oils such as tall oil fatty acids, castor oil fatty acids, rosin oil fatty acids, codfish oil fatty acids, neatsfoot oil fatty acids and mixtures of any of the above.

Preferred fatty acids have a backbone of from 6 to 22 carbon atoms, are unsaturated and are monocarboxylic. Examples of preferred fatty acids include, but are not limited to: caproleic, myristoleic, palmitoleic, oleic, gadoleic, gondoric, cetoleic, linoleic, linolenic, ricinoleic, tall oil fatty acids, castor oil fatty acids, codfish oil fatty acids, neatsfoot oil fatty acids, rosin oil fatty acids, and mixtures of any of the above.

Formaldehyde liberating compositions are used in the preparation of these agents. For example, formaldehyde can be used in the form of 10% to 40% aqueous solutions, 30% to 55% alcoholic solutions with alcohols such as methanol, n-butanol, i-butanol or the like. Formaldehyde can also be used in the form of a formaldehyde liberating composition such as its polymeric forms such as paraformaldehyde, trioxane, or the like. It is also to be understood that such formaldehyde liberating compositions include any form such as an acetal which is capable of producing formaldehyde such as acetals and the like.

Examples of sulfonating agents which may be employed include 96.5%, 98% and 100% sulfuric acid, sodium acid sulfate, chlorosulfonic acid, sulfur trioxide, oleums containing from 20% to 65% sulfur trioxide and the like. If desired, sulfonation may be carried out in a solvent such as acetic anhydride, ethylene dichloride, monochlorobenzene, acetone and the like. When a solvent is employed, from 10% to 500% of solvent based on the weight of the hydroxy aromatic component may be used.

The retanning and fatliquoring agents may be produced by a process employing the following steps:

(a) condensing one mole of a hydroxy component, from about 0.05 to about 1.5 mole of an unsaturated oil and from about 0.4 to about 1 mole of a formaldehyde liberating composition at from about 40° C to about 110° C to obtain a condensation product, then (b) drying the condensation product under vacuum, and thereafter (c) sulfonating the dried condensation product at from about 0° C to about 120° C with sufficient sulfonating agent to obtain the desired retanning and fatliquoring agent which is a sulfonated condensation product having from about 0.3 to about 1.5 moles $SO_3$ per mole of hydroxy component. The sulfonated condensation product may then be neutralized with a base such as aqueous sodium hydroxide to obtain a solution of the agent.

The agents prepared by the above process may be used as retans and fatliquors on leather tanned with vegetable, synthetic, mineral and other tannages to impart desirable characteristics to the leather. They may be used at from about 5% solids to about 50% solids and from about 30% to about 200% water based on the weight of leather.

The retanning and fatliquoring agents disclosed in this invention are useful on chrome tanned side leathers and splits. When used on chrome tanned side leather, they specifically impart to the chrome leather a soft fullness, a mellow grain and a hand which is light and warm. The replacement tanning values of these agents impart mellowness to the leather and attain the desired degree of softness. These characteristics of mellowness and softness are very desirable in glove, garment and soft type leathers. When they are used on chrome tanned side leather, about 5% solids to about 50% solids by weight of the agent based on the weight of the leather, the preferred amount being from about 10% to about 25% solids and from about 30% to about 200% water, are normally employed at a pH of from 5.0 to 3.0 and are introduced at 20° C to 60° C over from ½ to 8 hours. Further, these agents are particularly well suited for retanning and fatliquoring chrome tanned splits for garments, suedes and casual upper leather suedes. Use of these agents on splits improves oil distribution and eliminates bony areas. When they are used as relatively light retans, they provide retanned splits having silky naps with pleasing hands. Usually when these agents are used as retans and fatliquors on splits, from about 5% solids to about 50% soilids by weight of agent based on the weight of leather used is introduced at a pH of from 5.0 to 3.0 at from 20° C to 60° C over from ½ to 5 hours.

Beside accomplishing retanning and fatliquoring in one operation these agents have an additional advantage on dyeing applications. The exhaust of dyes is much improved, resulting in fuller, more saturated colors.

Thus it is clear that the products of the present invention are truly unique in that they are outstanding retanning and fatliquoring agents which bring about the production of outstanding leather.

The specific leather characteristics, such as grain appearance, degree of softness, will be determined by the choice of combination of oils used in preparing the agent.

For a fuller understanding of this invention, reference may be made to the following examples which are given merely to illustrate the invention and are not to be construed in a limiting sense. All weights, proportions and percentages are on a weight basis unless otherwise indicated. Likewise all temperatures are ° C unless otherwise indicated.

EXAMPLE I

This example demonstrates preparation of a sulfonated resin useful as a retanning and fatliquoring agent.

(A) Preparation of Resin

A hydroxy aromatic component was prepared by charging 141.0 g (1.50 m) of molten phenol under nitrogen to a reactor and then adding 162.0 g (1.50 m) of technical cresol to the agitated molten phenol under nitrogen at 40° C to 50° C. The technical cresol contained 66 to 74% o-cresol and 26 to 34% m-cresol and p-cresol and 3 to 7% xylenols.

Then 250.0 g of moellon was added to the agitated hydroxy aromatic component heated at 41° C to 48° C under nitrogen to obtain a homogeneous yellow-brown solution (color from moellon) which was cooled overnight under nitrogen to room temperature (22° C). The moellon was a waterless cod fish oil which had been cooked at 70° C to 75° C and blown.

The solution was then heated under nitrogen with agitation to 50° C and 3.0 g (0.03 m) of 98% sulfuric acid added as a catalyst. An exothermic reaction occurred and the temperature rose spontaneously to 56° C. The reaction mixture was then agitated at 52° C to 56° C under nitrogen for 30 minutes to effect the alkylation reaction and was then heated to 70° C over 10 minutes.

Then 60.0 g of paraformaldehyde 91% active (1.82 m) was added slowly. A very exothermic polymerization reaction occurred. The exothermic reaction produced a dark brown, more viscous liquid reaction mixture with water being split out. The first paraformaldehyde addition, 45.0 g (1.365 m) was added gradually in six 7.5g portions at 70° C to 80° C over a 30 minute period to the agitated reaction mixture under nitrogen. The reaction mixture was agitated an additional 30 minutes under nitrogen at 75° C to 80° C.

Then another 15.0 g (0.455 m) of paraformaldehyde was gradually added in three 5.0 g portions over 15 minutes to the agitated reaction mixture under nitrogen at 75° C to 80° C. Reaction during this addition was not as exothermic as during the first paraformaldehyde addition but the reaction mixture became more viscous with water being split out. The reaction mixture was then heated under nitrogen to reflux (105° C) over 30 minutes and then refluxed with stirring under nitrogen at 105° C to 107° C for 2 hours.

The apparatus was then set up for vacuum distillation to remove water formed during resin formation at a low vacuum of about 160 mm of Hg pressure over about 25 minutes. During distillation, the pot temperature dropped to 82° C because of water evaporation and the liquid was reheated to 100° C. Vapor temperature during most of the distillation was between 60° C and 65° C. Pressure was then gradually reduced to 25 mm Hg and the last traces of water were distilled off of the resin at 25 mm Hg pressure and a pot temperature of 95° C to 102° C for 5 minutes. Nitrogen was then admitted to release the vacuum and the reaction mixture was cooled to 88° C where it was still a smooth stirrable viscous dark brown liquid. A total of 42.6 g of volatiles, 1.4 g of oil phase and 41.2 g of water phase were removed during distillation.

Then 153.0 g (150 m) of acetic anhydride was added gradually from a dropping funnel over ten minutes to the reaction mixture. An exothermic reaction between the acetic anhydride and the mixture occurred and the reaction temperature rose spontaneously from 88° C to 105° C. The resulting smooth brown solution was heated to 115° C over 15 minutes to obtain a homogeneous dark brown liquid which on cooling to 23° C with stirring became a dark brown, very viscous liquid which was barely stirrable, but stirrable on heating to 30° C and above. The yield of resin was 726.4 g.

(B) Sulfonation of the Resin

A total of 726.4 g of resin from part (A) above was heated to 95° C to obtain a smooth readily stirrable liquid which was then cooled to 80° C. Then 200.0 g (2.0 m) of 98% sulfuric acid, which is equivalent to 196.0 g (2.0 m) of 100% sulfuric acid, was slowly added from a dropping funnel over 1 hour to the agitated resin while the resin was maintained at 80° C to 85° C under nitrogen. An exothermic reaction occurred. The reaction mixture became a more viscous dark brown homogeneous liquid. This liquid was stirred for an additional 2 hours at 80° C to 85° C under nitrogen, then heated to 100° C over 20 minutes, and stirred an additional hour at 100° C to 105° C to obtain the desired sulfonation reaction product.

The sulfonation reaction product was cooled with stirring under nitrogen to 70° C over 30 minutes and diluted by gradually adding with stirring over 10 minutes 600 g of water from a dropping funnel. During dilution, the temperature rose from 70° C to 76° C and then dropped to 50° C. After completion of dilution, the mixture was stirred for an additional 10 minutes at 45° C to 50° C. Then 280.0 g (3.50 m) of 50% sodium hydroxide was slowly added from a dropping funnel over 15 minutes at 45° C to 55° C while stirring the mixture under nitrogen and cooling in an ice bath.

After completion of sodium hydroxide addition, the mixture was heated to 60° C over 20 minutes and then 193.6 g of water was added over 5 minutes while stirring at 60° C to 62° C. The mixture was stirred an additional 5 minutes at 60° C to 62° C, Then cooled to room temperature (22° C) while stirring under nitrogen. At room temperature, the product was a very viscous stirrable dark brown liquid. It was then heated to 65° C and an additional 200 g of water was gradually added over five minutes from a dropping funnel while stirring under nitrogen at 65° C to 61° C. The product became less viscous as water was added. After completion of water addition, the product was stirred for 15 minutes at 60° C to 62° C under nitrogen and then cooled to room temperature while stirring under nitrogen.

The yield of sulfonated resin was 2197.0 g of a viscous brown liquid product in the form of a solution containing 42.0% solids. A 5% solution of the product in water formed a completely water soluble brown solution having a pH of 4.5.

EXAMPLE II

This example demonstrates preparation of a sulfonated resin useful as a retanning and fatliquoring agent.

(A) Preparation of Resin

A hydroxy aromatic component was prepared by charging 141.0 g (1.50 m) of molten phenol under nitrogen to a reactor and then adding 162.0 g (1.50 m) of technical cresol to the agitated molten phenol under nitrogen at 40° C to 50° C. Then 100.0 g of neatsfoot oil and 150.0 g of moellon was added to the agitated hydroxy aromatic component heated at 40° C to 50° C under nitrogen to obtain a homogeneous yellow-brown solution (color from moellon).

The solution temperature was adjusted to 50° C and 3.0 g (0.03 m) of 98% sulfuric acid added as a catalyst while stirring under nitrogen. An exothermic reaction occurred and the temperature rose spontaneously to 56° C. The reaction mixture was then agitated at 51° C to 56° C under nitrogen for 30 minutes to effect the alkylation reaction and was then heated to 70° C over 10 minutes.

Then 60.0 g of paraformaldehyde 91% active (1.82 m) was added slowly. A very exothermic polymerization reaction occurred. The exothermic reaction produced a drark brown, more viscous liquid reaction mixture with water being split out. The first paraformaldehyde addition, 45.0 g (1.365 m) was added gradually in six 7.5 g portions at 70° C to 80° C over a 30 minute period to the agitated reaction mixture under nitrogen. The reaction mixture was agitated at 70° C to 80° C an additional 30 minutes under nitrogen.

Then another 15.0 g (0.455 m) of paraformaldehyde was gradually added in three 5.0 g portions over 15 minutes to the agitated reaction mixture under nitrogen at 70° C to 80° C. This reaction was not as exothermic as the first paraformaldehyde addition but water split out and the reaction mixture became more viscous. The reaction mixture was then heated under nitrogen to reflux (105° C) over 25 minutes and refluxed with stirring under nitrogen at 105° C to 107° C for 2 hours.

The apparatus was then set up for vacuum distillation to remove water formed during resin formation at a low vacuum of about 160 mm of Hg pressure over about 23 minutes.

During distillation, the pot temperature dropped to 95° C because of water evaporation and the liquid was reheated to 105° C. Vapor temperature during most of the distillation was between 56° C and 80° C. Pressure was then gradually reduced to 25 mm Hg and the last traces of water were distilled off of the resin at 25 mm Hg pressure and a pot temperature of 95° C to 105° C for 7 minutes. Nitrogen was admitted to release the vacuum and the reaction mixture was cooled over fifteen minutes to 90° C where it was still a homogeneous stirrable viscous dark brown liquid. A total of 44.6 g of volatiles, 8.2 g of oil phase and 36.4 g of water phase were removed during distillation.

Then 153.0 g (1.50 m) of acetic anhydride was added gradually from a dropping funnel over ten minutes to the reaction mixture. An exothermic reaction between the acetic anhydride and the mixture occurred and the reaction temperature rose spontaneously from 90° C to 98° C. The resulting homogeneous brown solution was heated to 115° C over 20 minutes to obtain a homogeneous dark brown liquid which on cooling to 22° C and standing overnight at 22° C was a dark brown, very viscous liquid but still stirrable. The yield of resin was 724.4 g.

(B) Sulfonation of the Resin

A total of 724.4 g of resin from part (A) above was heated to 90° C to obtain a smooth readily stirrable liquid which was cooled to 80° C. Then 200.0 g (2.0 m) of 98% sulfuric acid, which is equivalent to 196.0 g (2.0 m) of 100% sulfuric acid, was slowly added to the agitated resin from a dropping funnel over one hour while the resin was maintained at 80° C to 82° C under nitrogen. An exothermic reaction occurred and produced a more viscous dark brown homogeneous liquid. This liquid was stirred for an additional 2 hours at 80° C to 85° C under nitrogen, then heated to 100° C over 15 minutes, and stirred an additional hour at 100° C to 105° C to obtain the sulfonation reaction product.

The sulfonation reaction product was cooled with stirring under nitrogen to 70° C and then diluted by gradually adding with stirring 600 g of water from a dropping funnel over 20 minutes. During dilution, the temperature rose from 70° C to 74° C during addition of first 30 g of water and then gradually dropped to 45° C. After dilution, the mixture was stirred for an additional 15 minutes at 40° C to 45° C. Then 280.0 g (3.50 m) of 50% sodium hydroxide was slowly added from a dropping funnel over 15 minutes at 40° C to 50° C while stirring the mixture under nitrogen and cooling in an ice bath.

After completion of sodium hydroxide addition, the mixture was heated to 60° C over 15 minutes. Then 195.6 g of water was added over 5 minutes with stirring. The mixture was stirred for fifteen minutes at 60° C to 65° C and then cooled to room temperature (22° C) while stirring under nitrogen. After standing overnight at room temperature, the product became a homogeneous very viscous dark brown pasty liquid which could not be stirred very effectively. It was then heated to 65° C and an additional 200 g of water was gradually added with stirring under nitrogen over ten minutes from a dropping funnel at 62° C to 65° C. The product became very fluid after the extra water was added. After this water addition, the product was stirred for 20 minutes at 60° C to 65° C under nitrogen and then cooled to room temperature while stirring under nitrogen.

The yield of sulfonated resin was 2195.0 g of a viscous dark brown liquid product in the form of a solution containing 42.0% solids. A 5% solution of the product in water formed a completely water soluble brown solution having a pH of 4.5.

EXAMPLE III

This example demonostrates preparation of a sulfonated resin useful as a retanning and fatliquoring agent.

(A) Preparation of Resin

A hydroxy aromatic component was prepared by charging 141.0 g (1.50 m) of molten phenol under nitrogen to a reactor and then adding 162.0 g (1.50 m) of technical cresol to the agitated molten phenol under nitrogen at 40° C to 50° C. Then 200.0 g of moellon was added to the agitated hydroxy aromatic component heated at 40° C to 50° C under nitrogen to obtain a homogeneous yellow-brown solution (color from moellon).

The solution was then heated at 50° C under nitrogen with agitation and 3.4 g (0.0327 m) of sodium sulfite added. Then 3.4 g (0.0335 m) of 96.5% sulfuric acid was added which caused the reaction temperature to rise to 55° C. The reaction mixture was then agitated at 45° C to 55° C under nitrogen for 30 minutes and then heated to 70° C.

Then 67.5 g (2.0475 m) of paraformaldehyde was added slowly, as described below. A very exothermic polymerization reaction occurred and produced a dark brown, more viscous liquid reaction mixture with water being split out. The first paraformaldehyde addition, 45.0 g (1.365 m) was added gradually at 70° C to 80° C over 30 minutes to the agitated reaction mixture under nitrogen. The reaction mixture was agitated an additional 30 minutes under nitrogen at 70° C to 80° C.

A total of 15.0 g (0.455 m) of paraformaldehyde was gradually added over 15 minutes to the agitated reaction mixture under nitrogen at 75° C to 80° C. Reaction during this addition was not as exothermic as during the first addition. The reaction mixture was then heated under nitrogen to reflux (105° C) over 30 minutes and refluxed with stirring under nitrogen at 105° C to 107° C for 1 hour. The mixture gradually became more viscous and lighter brown in color. It was allowed to cool from 105° C to 90° C over 30 minutes.

Then 7.5 g (0.2275 m) of paraformaldehyde was gradually added at 90° C to 95° C to the agitated reaction mixture. The agitated reaction mixture was heated to reflux over 30 minutes and refluxed at 104° C under nitrogen for an hour. A total of 67.5 g (2.0475 m) of paraformaldehyde was added during the three additions.

The apparatus was then set up for vacuum distillation to remove water formed during resin formation at a low vacuum over about 30 minutes.

During distillation, the pot temperature dropped to 85° C because of water evaporation and the liquid was reheated to 100° C. Pressure was then gradually reduced to 25 mm Hg and the last traces of water were distilled off of the agitated resin at 25 mm Hg pressure and a pot temperature of 105° C to 115° C. A total of 47.3 g of volatiles was removed as the water phase. Nitrogen was admitted to release the vacuum and the viscous brown liquid mixture was allowed to cool to 90° C.

Then 140.0 g (1.37 m) of acetic anhydride was added slowly from a dropping funnel over ten minutes to the agitated reaction mixture. An exothermic reaction between the acetic anhydride and the mixture occurred and the reaction temperature rose spontaneously from 90° C to 100° C. The resulting viscous brown solution was heated to 115° C, cooled to room temperature and allowed to stand overnight. The yield of resin was 670.0 g.

(B) Sulfonation of the Resin

A total of 670.0 g of resin from part (A) above was heated to 80° C. Then 190.0 g (1.872 m) of 96.5% sulfuric acid was slowly added to the agitated resin from a dropping funnel over 1 hour while the resin was maintained at 78° C to 82° C under nitrogen. An exothermic reaction occurred. The viscous dark brown liquid was stirred under nitrogen for 2 more hours at 80° C to 85° C, then heated to 100° C over 30 minutes (exotherm), stirred an hour at 100° C to 105° C and then an hour at 105° C to 110° C. The resulting sulfonation reaction product was cooled to room temperature and allowed to stand overnight. A sample of the product was completely soluble in water.

The sulfonation reaction product was reheated with stirring under nitrogen to 70° C and diluted by gradual addition of 400 g of water from a dropping funnel over 30 minutes to the agitated product at 70° C to 53° C. After dilution, the mixture was heated with agitation to 70° C to obtain a smooth homogeneous but viscous liquid and cooled to 45° C. Then 210.0 g (2.622 m) of 50% sodium hydroxide was slowly added from a dropping funnel over 1 hour at 45° C to 55° C while stirring the mixture under nitrogen and cooling in an ice bath to maintain the temperature. A sample of the product was completely soluble in water. A solution of 30.0 g (0.0878 m) of sucrose in 50.0 g water was added slowly to the product with stirring. Then a solution of 42.0 g (0.404 m) of sodium bisulfite in 150.0 g of water was gradually added with stirring.

After completion of these additions, temperature of the mixture dropped from 45° C to 40° C and the mixture was heated to 60° C and agitated at 60° C to 65° C for 30 minutes. Then 100.0 g of water was added slowly with stirring to reduce the vicosity. The solution was then stirred an additional 30 minutes at 60° C to 62° C, then cooled to room temperature (22° C) while stirring under nitrogen.

The yield of sulfonated resin was 1841.0 g of a very viscous dark brown liquid product in the form of a solution containing 45.0% solids. The product was completely water soluble and formed an amber solution. The product had a 12,500 cps Brookfield viscosity (#4 spindle at 30 rpm) at 22° C. A 10% solution of the product in water had a pH of 4.4.

EXAMPLE IV

This example demonstrates preparation of a sulfonated resin useful as a retaining and fatliquoring agent.

(A) Preparation of Resin

A hydroxy aromatic component was prepared by charging 141.0 g (1.50 m) of molten phenol under nitrogen to a reactor and then adding 162.0 g (1.50 m) of technical cresol to the agitated molten phenol under nitrogen at 40° C to 50° C.

Then 200.0 g of moellon was added to the agitated hydroxy aromatic component at 40° C to 50° C under nitrogen to obtain a homogeneous yellow-brown solution (color from moellon). Then 3.4 g (0.034 m) of 98% sulfuric acid was added as a catalyst while stirring under nitrogen at 50° C. An exothermic reaction occurred and the temperature rose spontaneously to 54° C. The reaction mixture was then agitated at 50° C to 55° C under nitrogen for 30 minutes and heated to 70° C.

The first paraformaldehyde addition, 45.0 g (1.365 m) was added gradually in six 7.5 g portions at 70° C to 80° C over a 30 minute period to the agitated reaction mixture under nitrogen. The first paraformaldehyde addition was made slowly. A very exothermic polymerization reaction occurred and produced a dark brown, more viscous liquid reaction mixture with water being split out. After this solution, the reaction mixture was agitated an additional 30 minutes under nitrogen at 75° C to 80° C.

Then another 15.0 g (0.455 m) of paraformaldehyde was gradually added in three 5.0 g portions over 15 minutes to the agitated reaction mixture under nitrogen at 75° C to 80° C. Reaction was not as exothermic as during the first paraformaldehyde addition but the reaction mixture became more viscous. The reaction mixture was then heated under nitrogen to reflux (105° C) over 30 minutes and then refluxed with stirring under nitrogen at 105° C to 107° C for 1 hour.

After allowing the reaction mixture to cool for 10 minutes to 90° C, another 7.5 g (0.2275 m) of paraformaldehyde was added at 90° C to 95° C to the agitated mixture. The reaction mixture was then heated to reflux and refluxed at 104° C under nitrogen for an hour. The total paraformaldehyde addition was 67.5 (2.0475 m).

The apparatus was then set up for vacuum distillation to remove water produced during resin formation. Most of the water was distilled at a vacuum of above 150 mm of Hg pressure over about 30 minutes. During distillation, the pot temperature dropped to 80° C because of water evaporation and the liquid was reheated to 105° C. Vapor temperature during distillation at above 150 mm pressure was between 64° C and 87° C. Pressure was then gradually reduced to 25 mm Hg and the last traces of water were distilled off of the resin at 25 mm Hg pressure and a pot temperature of 105° C to 110° C for ten minutes. A total of 47.6 g volatiles, 1.2 g of oil phase and 46.4 g of water phase were removed during distillation. The viscous brown resin was then allowed to cool under nitrogen with agitation to 85° C.

Then 140.0 g (1.37 m) of acetic anhydride was added gradually from a dropping funnel over fifteen minutes to the stirred reaction mixture. An exothermic reaction occurred between the acetic anhydride and the mixture and the reaction temperature rose spontaneously from 85° C to 95° C. The resulting smooth brown solution was heated under nitrogen with agitation to 115° C and then cooled to obtain 666.3 g of brown viscous resin.

(B) Sulfonation of the Resin

A total of 666.3 g of resin from part (A) above was heated to 95° C and then cooled to 80° C. Then 190.0 g (1.9 m) of 98% sulfuric acid, which is equivalent to 186.0 g (1.9 m) of 100% sulfuric acid, was slowly added over 1 hour from a dropping funnel to the agitated resin while the resin was maintained at 80° C to 85° C under nitrogen. An exothermic reaction occurred. The resulting viscous dark brown reaction mixture was stirred for an additional 2 hours at 80° C to 90° C under nitrogen, then heated to 100° C over 10 minutes, and stirred an additional hour under nitrogen at 100° C to 102° C to obtain the desired sulfonation reaction product.

The sulfonation reaction product was cooled with stirring under nitrogen to 82° C and diluted by gradually adding with stirring 500.0 g of water from a dropping funnel over 15 minutes. During dilution, the temperature rose from 82° C to 85° C and then dropped to 55° C. After dilution, the mixture was stirred for an additional 15 minutes at 55° C to 50° C. Then 210.0 g (2.622 m) of 50% sodium hydroxide was slowly added from a dropping funnel over 20 minutes at 45° C to 50° C while stirring the mixture under nitrogen and cooling in an ice bath. The product became more viscous during neutralization.

After completion of sodium hydroxide addition, an additional 100.0 g of water was gradually added over five minutes while stirring at 45° C to 40° C. Then the mixture was heated to 60° C and stirred for 30 minutes at 60° C to 65° C. Another 100.0 g of water was added while stirring at 64° C to 65° C. The mixture stirred an additional 30 minutes at 60° C to 65° C and then cooled to room temperature (22° C) while stirring under nitrogen.

The yield of sulfonated resin was 1767.4 g of a viscous brown liquid product in the form of a solution containing 44.4% solids. The Brookfield viscosity of the product was 10,020 cps at 22° C with a #4 spindle at 30 rpm and 10,450 cps with a #4 spindle at 12 rpm. A 5% solution of the product in water was a completely water soluble brown solution having a pH of 4.3.

EXAMPLE V

This example demonstrates preparation of a sulfonated resin useful as a retanning and fatliquoring agent.

(A) Preparation of Resin

A hydroxy aromatic component was prepared by charging 141.0 g (1.50 m) of molten phenol under nitrogen to a reactor and then adding 162.0 g (1.50 m) of technical cresol to the agitated molten phenol under nitrogen at 40° C to 50° C. Then 300.0 g of moellon was added to the agitated hydroxy aromatic component at 40° C to 50° C.

The solution was then heated under nitrogen with agitation to 50° and 3.4 g (0.034 m) of 98% sulfuric acid added as a catalyst. An exothermic reaction occurred and the temperature rose spontaneously to 55° C. The reaction mixture was agitated at 50° C to 55° C under nitrogen for 30 minutes to effect the alkylation reaction and then heated to 70° C.

Then 67.5 g (2.0475 m) of paraformaldehyde was added slowly. A very exothermic polymerization reaction occurred spliting out water and producing a dark brown, more viscous liquid. The first paraformaldehyde addition, 45.0 g (1.365 m) was added gradually in six 7.5 g portions at 70° C to 80° C over 30 minutes to the agitated mixture under nitrogen. The reaction mixture was then agitated for 30 minutes more under nitrogen at 75° C to 80° C.

Then 15.0 g (0.455 m) of paraformaldehyde was gradually added in three 5.0 g portions over 15 minutes to the agitated mixture under nitrogen at 75° C to 80° C. This reaction was not as exothermic as during the first paraformaldehyde addition but the reaction mixture became progressively more viscous as water was being split out. The reaction mixture was then heated under nitrogen to reflux over 30 minutes and then refluxed with stirring under nitrogen at 105° C for 1 hour.

The reaction mixture was cooled to 90° C over 10 minutes and 7.5 g (0.2275m) of paraformaldehyde was gradually added to the agitated heated mixture under nitrogen at 90° C to 95° C. Then the mixture was reheated to reflux and refluxed 1.5 hours at 104° C under nitrogen. Viscosity of the mixture increased during reflux.

The apparatus was then set up for vacuum distillation to remove water formed during resin formation at a low vacuum (above 160 mm Hg pressure) over about 30 minutes.

During distillation, the pot temperature dropped to 79° C because of water evaporation and the liquid was reheated to 105° C. Pressure then gradually reduced to 25 mm Hg. Last traces of water were distilled off of the resin at this pressure and a pot temperature of 105° C to 115° C for 10 minutes. A total of 48.6 g of volatiles, 1.4 g of oil phase and 47.2 g of water phase was removed during distillation. The very viscous dark brown resin cooled to 85° C.

Then 140.0 g (1.37 m) of acetic anhydride was added gradually from a dropping funnel over fifteen minutes to the reaction mixture. An exothermic reaction between the acetic anhydride and the mixture occurred and the reaction temperature rose spontaneously from 85° C to 95° C. The reaction mixture was heated to 150° C, refluxed and then cooled to obtain 765.3 g of dark brown resin.

(B) Sulfonation of the Resin

A total of 765.3 g of resin from part (A) above was heated to 95° C and then cooled to 80° C. Then 190.0 g (1.9 m) of 98% sulfuric acid was slowly added to the agitated resin from a dropping funnel over 1 hour while the resin was maintained at 80° C to 85° C under nitrogen. An exothermic reaction occurred producing a more viscous dark brown homogeneous liquid. This liquid was stirred for an additional 2 hours at 80° C to 85° C under nitrogen, then heated to 100° C over 10 minutes, and stirred under nitrogen an additional hour at 100° C to 105° C to obtain a sulfonation reaction product.

The sulfonation reaction product was cooled with stirring under nitrogen to 80° C over 20 minutes and diluted by a gradual addition of 600 g of water from a dropping funnel to the stirred product over 15 minutes. The deep brown viscous reaction product was completely water soluble. During dilution, temperature rose from 80° C to 83° C and then dropped to 53° C. After dilution, the mixture was stirred for an additional 15 minutes at 50° C to 55° C. Then 210.0 g (2.622 m) of 50% sodium hydroxide was slowly added from a dropping funnel over 25 minutes at 45° C to 55° C while stirring the mixture under nitrogen and cooling in an ice bath.

After completion of this addition, a total of 750.0 g of water was added in three portions together with 10 g more of 50% sodium hydroxide solution and the mixture stirred at 60° C to 75° C. After cooling to room temperature (22° C), 2525.3 g of sulfonated resin was obtained in the form of a very viscous brown liquid solution which contained 35.0% solids. A 5% solution of this product in water had a pH of 4.0.

EXAMPLE VI

This example demonstrates preparation of a sulfonated resin useful as a retanning and fatliquoring agent.

(A) Preparation of Resin

A hydroxy aromatic component was prepared by charging 141.0 g(1.50 m) of molten phenol under nitrogen to a reactor and then adding 162.0 g (1.50 m) of technical cresol to the agitated molten phenol under nitrogen at 40° C to 50° C.

Then 250.0 g of moellon was added to the agitated hydroxy aromatic component heated at 40° C to 50° C under nitrogen to obtain a solution. The solution was then heated under nitrogen with agitation to 50° C and 3.0 g (0.03 m) of 98% sulfuric acid added as a catalyst. An exothermic reaction occurred and the temperature rose spontaneously to 54° C. The reaction mixture was then agitated at 50° C to 55° C under nitrogen for 30 minutes and then heated to 70° C over 10 minutes.

Then 67.5 g (2.0475 m) of paraformaldehyde was added slowly. The first 45.0 g (1.365 m) of paraformaldehye was added gradually in six 7.5 g portions at 70° C to 80° C over a 30 minute period to the agitated reaction mixture under nitrogen. A very exothermic polymerization reaction occurred and produced a dark brown, more viscous liquid reaction mixture with water being split out. The reaction mixture was agitated an additional 30 minutes under nitrogen at 75° C to 80° C.

Then 15.0 g (0.445 m) of paraformaldehyde was gradually added in three 5.0 g portions to the agitated reaction mixture under nitrogen at 75° C to 80° C. The reaction mixture was then heated under nitrogen to reflux (105° C) over 25 minutes and then refluxed with stirring under nitrogen at 105° C for 1 hour. The mixture was cooled to 95° C over 10 minutes and 7.5 g (0.2275 m) of paraformaldehyde added gradually at 95° C and the mixture reheated to reflux and refluxed under nitrogen for 1 hour.

The apparatus was then set up for vacuum distillation to remove water formed during resin formation at a low vacuum (above 160 mm Hg pressure).

Most of the water was removed during 30 minutes. The pot temperature dropped to 80° C because of water evaporation and the liquid was reheated to 100° C. Pressure was then gradually reduced to 25 mm Hg and the last traces of water were distilled off of the resin at 25 mm Hg pressure and a pot temperature of 96° C to 101° C. Nitrogen was then admitted to release the vacuum and the reaction mixture was cooled to 93° C. A total of 44.9 g of volatiles, 1.1 g of oil phase and 43.8 g of water phase were removed during distillation.

Then 153.0 g (1.50 m) of acetic anhydride was added gradually to the reaction mixture from a dropping funnel over 10 minutes. An exothermic reaction occurred between the acetic anhydride and the mixture and the reaction temperature rose spontaneously from 93° C to 103° C. The resulting smooth brown solution was heated to 115° C over 15 minutes and then cooled to room temperature to obtain 731.6 g of dark brown resin.

(B) Sulfonation of the Resin

A total of 731.6 g of resin from part (A) above was heated to 95° C to obtain a dark brown liquid which was then cooled to 80° C. Then 190.0 g (1.9 m) of 98% sulfuric acid was slowly added to the agitated resin from a dropping funnel over 1 hour while the resin was maintained at 80° C to 85° C under nitrogen. An exothermic reaction occurred producing a more viscous dark brown homogeneous liquid. This liquid was stirred for an additional 2 hours at 80° C to 85° C under nitrogen, then heated to 100° C over 10 minutes and stirred an additional hour at 100° C to 105° C to obtain a sulfonation reaction product.

The sulfonation reaction product was cooled with stirring under nitrogen to 75° C and diluted by gradually adding with stirring 600 g of water from a dropping funnel over 5 minutes. During dilution, the temperature rose to 84° C and then dropped to 55° C. After dilution, the mixture was stirred for an additional 10 minutes at 50° C to 55° C. Then 240.0 g (3.00 m) of 50% sodium hydroxide was slowly added from a dropping funnel over 20 minutes at 45° C to 55° C while stirring the mixture under nitrogen and cooling in an ice bath.

After completion of sodium hydroxide addition, the mixture was heated to 60° C and then 238.4 g of water was added over 5 minutes while stirring at 60° C to 65° C.

In order to obtain a liquid having a lower viscosity at room temperature, 200.0 g of water was added and the diluted liquid stirred at 60° C to 65° C. The diluted liquid was then cooled to 22° C to obtain 2200.0 g of a dark brown solution containing 40.0% solids. A 5.0% aqueous solution had a pH of 4.2.

EXAMPLE VII

This example demonstrates preparation of a sulfonated resin useful as a retanning and fatliquoring agent.

A mixture of 100 g (0.107 m) castor oil, 152 g (1.5 m) of hydroxy aromatic component, 1.7 g of 96% sulfuric acid and 1.7 g of sodium hydrosulfite were charged to a reactor. The hydroxy aromatic component was a mixture of 72 g of phenol and 80 g of technical cresol. The molar ratio of alkyl chains in the castor oil to aromatic rings in the phenol was 0.321/1.5 which equals 0.214. The reaction mixture was heated with agitation at 50° C under a nitrogen blanket and 45 g (1.36 m) of 91% paraformaldehyde was added in 8 equal portions to the agitated mixture for over 30 minutes. Final temperature at end of the addition was 105° C. The reaction mixture was then refluxed for 1 hour and the resulting reaction product, the desired resin, was dried under vacuum to remove a total of 26 g of water and 2 g of oil.

The dried resin was cooled to 70° C under vacuum. The vacuum was released and 70 g of acetic anhydride was added slowly. Maximum temperature during the anhydride addition was 110° C. After the anhydride addition was complete, the mixture was cooled to 50° C and 95 g of 98% sulfuric acid was added slowly over 2.25 hours. The final reaction temperature at the end of the sulfuric acid addition was 75° C. After the sulfonation was complete, the reaction mixture was cooled to 45° C over 1 hour and 20 minutes. Then 200 g of water was added to the sulfonated resin and mixed to obtain a uniform solution. A total of 105 g of 50% sodium hydroxide solution was then added to the resin solution and followed by additions of 15 g of dextrose, 21 g of sodium hydrosulfite and 100 g of water. Final pH of a 10% solution of the sulfonated resin was 3.5.

EXAMPLE VIII

This example demonstrates preparation of a sulfonated resin using the procedure of Example VII with the exception that 115 g of 98% sulfuric acid was used to sulfonate the dried resin instead of 95 g of 98% sulfuric acid.

EXAMPLE IX

This example demonstrates preparation of a sulfonated resin using the precedure of Example VII with the exception that the step involving sulfonation of the dry resin was replaced by omega sulfonation of wet resin in aqueous media using the procedural step given below.

The wet resin described in Example VII was not dried but mixed with 500 g of water, 151 g of sodium sulfite and 107 g of 37% by weight aqueous formaldehyde solution at room temperature. This mixture was heated to 100° C and reacted for 8 hours at 100° C to obtain an emulsion of the sulfonated resin. The pH of the emulsion was adjusted to 7.0 using 24 g of 98% sulfuric acid. Then 60 g of formic acid was added to obtain a heavy white emulsion of the sulfonated resin having a pH of 3.7.

EXAMPLE X

This example demonstrates retanning and fatliquoring with the agent from Example I.

Each of three rotating tanning vessels (jars in tumbler) was charged with a 220.0 g pack (3 pieces) of commercial blue stock (blue side grains). The three packs were designated Samples #1 to #3. The packs were washed for 15 minutes at 38° C in 500 ml of water and then drained. They were partially neutralized by treating each pack for 30 minutes at 38° C with 220 ml of water and 33 ml of 5.0% sodium bicarbonate solution. Each pack was drained and the supernatant liquid checked for pH. The pH varied from 6.07 to 6.02 to 6.05 depending on the pack. Then each pack was washed again for 10 minutes in 500 ml of water at 43° C and drained. Each vessel containing a pack was then charged with 220 ml of water at 43° C and the indicated amount of retanning and fatliquoring agent from Example I shown below.

| | Amount of Example I Used per 220 ml Water | |
|---|---|---|
| Pack Sample | % by Weight | Weight |
| #1 | 10% | 22.0 g |
| #2 | 15% | 33.0 g |
| #3 | 20% | 44.0 g |

The pack was run with the retanning and fatliquoring agent at 43° C for 2 hours in the rotating vessel to retan and fatliquor.

Then the liquid was drained from the pack and the pH measured to obtain the following results. The pH was found to vary slightly depending on the pack.

| Pack Sample | pH (at end) |
|---|---|
| #1 | 4.07 |
| #2 | 4.08 |
| #3 | 4.13 |

The wet leather was horsed overnight at room temperature.

The next day excess liquid was removed from each piece of leather using a hand operated wringer. Then each piece was tacked on boards and dried for 4 hours at 45° C to 50° C in an oven having a forced air draft.

The dried leather was removed from the oven and from the boards and allowed to stand overnight at room temperature to equilibrate with moisture present in the air.

The retanned and fatliquored leather from all three packs was excellent with a good break and good physical properties.

These results illustrate how products of this invention represent improvement over the art by providing a single agent which can be used in a combination retanning and fatliquoring process in leather manufacture. Use of this agent can result in savings of material, labor and machine time in the leather manufacturing process.

The combination retanning and fatliquoring agent produced excellent quality leather which had very good appearance, feel and very good break (i.e., showed very little break). Further, physical properties of the leather were excellent. The tests for tensile strength, stitch tear and grain crack also gave very good results. The improved relative uniformity of the leather in different sections of the hide can be a distinct advantage.

If desired, a dyeing step in the same liquor may be incorporated in the combination retanning and fatliquoring process with this agent. An improved color yield was noted in a combination retanning and fatliquoring process where such a dyeing step was incorporated.

EXAMPLE XI

This example demonstrates retanning and fatliquoring with agents from Example II through Example VI.

Each rotating tanning vessel (jars in tumbler) was charged with a 220.0 g pack (3 pieces) of commercial blue stock (blue side grains). The three packs were marked Sample #1, #2 and #3. Contents of each vessel were washed with 500 ml of water for 15 minutes at 100° F and then drained. Each pack was partially neutralized by treating it for thirty minutes at 100° F with 220 ml of water and 22 ml of 5.0% sodium bicarbonate solution. Each pack was then drained and the supernatant liquid from the packs checked for pH. The pH of the liquids from the packs were 6.09, 6.02 and 6.00 respectively.

Each pack was washed again for 10 minutes in 500 ml of water at 110° F and drained. Each vessel containing a pack was then charged with 220 ml of water at 110° F and the amount of retanning and fatliquoring agent from Example II shown below.

| Pack Sample | Amount of Example II Used per 220 ml Water | |
|---|---|---|
| | % by Weight | Weight |
| #1 | 10% | 22.0 g |
| #2 | 15% | 33.0 g |
| #3 | 20% | 44.0 g |

Each pack was run with the agent at 110° F to 116° F for two hours in the rotating vessel to retan and fatliquor.

Then liquid was drained from the pack. The pH of the liquid was measured and found to be as follows.

| Pack Sample | pH (at end) |
|---|---|
| #1 | 4.09 |
| #2 | 4.11 |
| #3 | 4.14 |

The wet leather was horsed overnight at room temperature and then excess liquid was removed from each piece of leather using a hand operated wringer. Each piece of leather was tacked on boards and dried for 4 hours at 45° C to 50° C in an oven equipped with a blower for forced air draft. The dried leather was removed from the oven and from the boards and then allowed to stand overnight at room temperature to equilibrate with the moisture of the air.

Leather from all three packs was excellent. It was a strong full leather. The break was very good, that is, it showed no wrinkling on sharp bending. Physical properties of the leather produced with the agent were good.

The above procedure was repeated with the agents from Examples III through VI and comparable results were obtained.

EXAMPLE XII

This example demonstrates retanning and fatliquoring agent from Example VII.

A 200 g piece of side leather blue stock was washed for 30 minutes in a drum and drained. The stock was then floated in 100% water at 100° F in the drum and 10% (20 g) of the retanning and fatliquoring agent from Example VII was added to obtain a tanning and fatliquoring liquid. The stock was rotated in the liquid for 1 hour. Exhaust of the agent from the liquid was good. Final pH of the liquid was 3.4. The sample was then warmed for 30 minutes, rinsed in a nonfat rinse and dried. Evaluation showed that the resulting leather was very good in appearance, had considerable softness, was tight and smooth.

EXAMPLE XIII

This example demonstrates retanning and fatliquoring agents from Example VIII and Example IX.

The agents described in Examples VIII and IX were evaluated against a commercial syntan which was a condensation product of phenol sulfonic acid, cresol sulfonic acids, urea and formaldehyde. Three 200 g peices of side leather blue stock were washed for 30 minutes in a drum and drained. Each piece was then retanned by running 2 hours at 37° C in a drum with 10% (20 g) of each of the agents shown below.

TABLE

| Treated With Agent | Type of Exhaust | Exhaust pH |
|---|---|---|
| Commercial | Good | 3.8 |
| Example VIII | Good | 3.7 |
| Example IX | Good | 3.7 |

After retanning, the pieces were rinsed and sampled. The commercial sample was then fat liquored with 5% of a fatty liquor which was a sulfated mixture of animal and vegetable oils. The samples for Example VIII and Example IX and the commercial syntan sample were then dried and evaluated to obtain the results shown below.

| Produced With Agent | Softness |
|---|---|
| Commercial | Soft |
| Example VIII | Soft |
| Example IX | Soft |

While the invention has been described with reference to certain specific embodiments thereof, it is understood that it is not to be so limited since alterations and changes may be made therein which are within the full intended scope of the appended claims.

What is claimed is:

1. A retanning and fatliquoring agent comprising a sulfonated condensation product of (a) one mole of a hydroxy component selected from the group consisting of phenol and a lower alkyl phenol having at least one alkyl of from one to two carbon atoms and at least one reactive hydrogen in the 2-, 4- or 6-position of the alkyl phenol, (b) from about 0.05 to about 1.5 mole of an unsaturated oil having an iodine value of over 60, and (c) from about 0.4 to about 1.0 mole of a formaldehyde liberating composition wherein the $SO_3$ content of the sulfonated condensation product is from about 0.3 to about 1.5 mole of $SO_3$ per mole of hydroxy component.

2. The agent of claim 1 wherein the hydroxy component is selected from the group consisting of phenol and technical cresol.

3. The agent of claim 1 wherein the oil is selected from the group consisting of moellon, castor oil and neatsfoot oil.

4. The agent of claim 1 wherein the formaldehyde liberating composition is selected from the group consisting of formaldehyde, paraformaldehyde and formalin.

5. The agent of claim 1 wherein the hydroxy component is a mixture of phenol and technical cresol, the oil is castor oil and the formaldehyde liberating composition is paraformaldehyde.

6. The agent of claim 1 wherein the hydroxy component is a mixture of phenol and technical cresol, the oil is moellon and the formaldehyde liberating composition is paraformaldehyde.

7. A process for producing the agent of claim 1 comprising (a) condensing one mole of a hydroxy component, from about 0.05 to about 1.5 mole of an unsaturated oil having an iodine value of over 60 and from about 0.4 to about 1 mole of a formaldehyde liberating composition at from about 40° C to obtain a condensation product, then (b) drying the condensation product under vacuum, and thereafter (c) sulfonating the dried condensation product at from about 0° C to about 120° C with sufficient sulfonating agent to obtain a sulfonated condensation product having from about 0.3 to about 1.5 moles $SO_3$ per mole of hydroxy component.

8. The process of claim 7 wherein the hydroxy component is selected from the group consisting of phenol and technical cresol.

9. The process of claim 7 wherein the unsaturated oil is selected from the group consisting of moellon, castor oil and neatsfoot oil.

10. The process of claim 7 wherein the formaldehyde liberating composition is selected from the group consisting of formaldehyde, paraformaldehyde and formalin.

11. The process of claim 7 wherein the sulfonating agent is selected from the group consisting of sulfuric acid, sulfur trioxide, chlorosulfonic acid, oleum and sodium acid sulfate.

12. A process of retanning and fatliquoring tanned leather comprising introducing from about 5 to about 50% by weight of the agent of claim 1 and from 30 to about 200% by weight of water based on the weight of the leather and thereafter drumming the leather with the agent to retan and fatliquor the leather.

13. The process of claim 12 wherein leather is drummed at from about 20° C to about 60° C for about ½ to about 8 hours to retan and fatliquor the leather.

14. The process of claim 12 wherein the tanned leather is selected from the group consisting of chrome tanned leather, mineral tanned leather, vegetable tanned leather and synthetic tanned leather.

15. Leather retanned and fatliquored by the process of claim 12.

16. The agent of claim 1 wherein the unsaturated oil is selected from the group consisting of a vegetable oil and an animal oil having an iodine value of over 60.

17. The agent of claim 16 wherein the unsaturated oil is a vegetable oil having an iodine value of over 60.

18. The agent of claim 16 wherein the unsaturated oil is an animal oil having an iodine value of over 60.

19. The process of claim 7 wherein the unsaturated oil is selected from the group consisting of a vegetable oil and an animal oil having an iodine value of over 60.

20. The process of claim 19 wherein the unsaturated oil is a vegetable oil having an iodine value of over 60.

21. The process of claim 19 wherein the unsaturated oil is an animal oil having an iodine value of over 60.

22. The process of claim 12 wherein the unsaturated oil is selected from the group consisting of a vegetable oil and an animal oil having an iodine value of over 60.

* * * * *